US010779382B2

(12) United States Patent
Keitel-Schulz et al.

(10) Patent No.: US 10,779,382 B2
(45) Date of Patent: Sep. 15, 2020

(54) SEMICONDUCTOR DEVICE FOR OUTPUTTING A CONTROL PARAMETER

(71) Applicant: Infineon Technologies AG, Neubiberg (DE)

(72) Inventors: Doris Keitel-Schulz, Hoehenkirchen (DE); Matthias Schneider, Kirchheim (DE); Qi Zhu, Munich (DE); Dieter Zipprick, Huellhorst (DE)

(73) Assignee: Infineon Technologies Austria AG, Neubiberg (DE)

( * ) Notice: Subject to any disclaimer, the term of this patent is extended or adjusted under 35 U.S.C. 154(b) by 0 days.

(21) Appl. No.: 16/595,823

(22) Filed: Oct. 8, 2019

(65) Prior Publication Data

US 2020/0120773 A1 Apr. 16, 2020

(30) Foreign Application Priority Data

Oct. 12, 2018 (DE) ..... 20 2018 004 757 U

(51) Int. Cl.
*H05B 37/02* (2006.01)
*H05B 47/19* (2020.01)
*H05B 45/20* (2020.01)

(52) U.S. Cl.
CPC ..... *H05B 47/19* (2020.01); *H05B 45/20* (2020.01)

(58) Field of Classification Search
CPC ..... H05B 45/20; H05B 47/00; H05B 47/10; H05B 47/19; H05B 47/105; H05B 47/175; H05B 47/195
See application file for complete search history.

(56) References Cited

U.S. PATENT DOCUMENTS 8,098,024 B1 * 1/2012 Gordin ..... H05B 41/40 315/291
8,729,446 B2 * 5/2014 Verfuerth ..... G08G 1/0116 250/205

(Continued)

FOREIGN PATENT DOCUMENTS

DE 10 2011 081975 A1 3/2013

OTHER PUBLICATIONS

Office Action, DE 20 2018 004 757.0, dated Jul. 12, 2019, pp. 5.
Office Action, EP 19 20 0685, dated Feb. 14, 2020, pp. 11.

*Primary Examiner* — Alexander H Taningco
*Assistant Examiner* — Kurtis R Bahr
(74) *Attorney, Agent, or Firm* — Armis IP Law, LLC

(57) ABSTRACT

A semiconductor device for outputting a control parameter includes a receiving unit, a storage unit and an output unit. The semiconductor device also contains antenna connections, supply connections and at least one output connection for outputting a control parameter signal. The receiving unit contains connections for connection to an antenna, from which the receiving unit receives signals. The receiving unit converts the signals received from the antenna into data. The data are stored in the storage unit. The semiconductor device outputs an output signal at the output connection on the basis of the data stored in the storage unit. The semiconductor device additionally contains a calculation unit which determines the operating hours (time) of the semiconductor device. The output signal depends both on the data stored in the storage unit and on the determined operating hours (time).

27 Claims, 3 Drawing Sheets

(56) References Cited

U.S. PATENT DOCUMENTS

| | | | | |
|---|---|---|---|---|
| 8,921,751 | B2 * | 12/2014 | Verfuerth | H05B 41/36 250/205 |
| 2007/0252528 | A1 * | 11/2007 | Vermuelen | H05B 47/19 315/34 |
| 2009/0085652 | A1 | 4/2009 | Wiatr et al. | |
| 2009/0195214 | A1 * | 8/2009 | Gehrke | H02J 7/0068 320/137 |
| 2010/0320962 | A1 * | 12/2010 | Sekita | H02J 50/80 320/108 |
| 2011/0254554 | A1 | 10/2011 | Harbers | |
| 2012/0274208 | A1 * | 11/2012 | Chen | H05B 45/00 315/34 |
| 2013/0049603 | A1 | 2/2013 | Bradford | |
| 2013/0285544 | A1 * | 10/2013 | Molezion | H01Q 1/22 315/34 |
| 2014/0001959 | A1 * | 1/2014 | Motley | H05B 45/10 315/149 |
| 2016/0352883 | A1 * | 12/2016 | McKelvey | H04W 12/06 |
| 2017/0122546 | A1 * | 5/2017 | Abbott | F21S 8/085 |
| 2018/0160513 | A1 | 7/2018 | Han et al. | |

* cited by examiner

SEMICONDUCTOR DEVICE FOR OUTPUTTING A CONTROL PARAMETER

RELATED APPLICATION

This application is related to and claims priority to earlier filed German patent application serial number 20 2018 004757.0 entitled "SEMICONDUCTOR DEVICE FOR OUTPUTTING A CONTROL PARAMETER," filed on Oct. 12, 2018, the entire teachings of which are incorporated herein by this reference.

BRIEF DESCRIPTION

Embodiments herein include different implementations of a semiconductor device for outputting a control parameter. Luminaires mounted on the ceiling often differ in terms of their power and therefore in terms of the light intensity output by them. Other parameters, such as the light color, may also differ from luminaire to luminaire. For this purpose, there are control devices on the luminaires which can be used to set the light intensity and the light color, for example. This setting operation can be carried out, for example, by virtue of an installer either connecting particular connections of the control devices to one another by means of wire jumpers or leaving these connections free and not making contact with them. The desire is to carry out this setting operation with less effort without reducing the number and quality of settable options.

Embodiments herein include a semiconductor device which can be used to set control parameters, for example, for luminaires.

One embodiment as described herein provides a semiconductor device for outputting a control parameter, which semiconductor device contains a receiving unit, a storage unit and an output unit. The semiconductor device also contains antenna connections, supply connections and at least one output connection for outputting a control parameter signal. The receiving unit contains connections for connection to an antenna, from which the receiving unit receives signals. The receiving unit converts the signals received from the antenna into data. The data are stored in the storage unit. The semiconductor device outputs an output signal at the output connection on the basis of the data stored in the storage unit. The semiconductor device additionally contains a calculation unit which determines the operating hours (time) of the semiconductor device. The output signal depends both on the data stored in the storage unit and on the determined operating hours (time).

In one embodiment, operating hours (passage of time) need not be stored in units corresponding to whole hours. It suffices to store them in a form from which multiples or fractions of operating hours can be calculated.

The apparatus shown and corresponding method of operation makes it possible to wirelessly program the semiconductor device, as a result of which the time needed for installation is reduced. For example, assume that an installer wishes to set a luminaire, for example, no longer needs to wire any cables, but rather can move his cellphone over the semiconductor device and program it in the process. The programmed settings which are received by the receiving unit by means of the antenna via the wireless signal are stored as data in the store, with the result that they are available for operation. The settings are, for example, the desired luminous intensity or desired light color in the case of luminaires or the speed in the case of motors, that is to say controllable properties of a device to be driven.

At the same time, it is taken into account that, with an increasing number of operating time (hours), the properties of the device being controlled can also change. For example, the emitted light intensity decreases with increasing age of the luminous device producing respective light. This can be counteracted by increasing the current, which flows through the luminous device, with increasing age of the luminaire. The signal which is output and signals, for example, that a higher current is intended to be impressed when the lamp becomes older changes accordingly.

In one embodiment, the calculation unit contains a counter which counts the operating time (such as measured in hours or other suitable unit). Such a counter is activated whenever voltage is provided by the luminaire. In this case, it is assumed that, if a voltage is present, the luminaire is also operated and converting electrical energy into outputted light. The time for which the luminaire is operated corresponds to the time in which the semiconductor device is supplied with voltage by the supply connections. In one embodiment, the time counter is not activated if a supply voltage is not provided via the supply connections. If the semiconductor device is supplied with voltage only via the antenna connections, it is assumed that the lamp is not on.

According to one embodiment, the output signal is an analog voltage. Such an analog voltage may be received as a control parameter from that circuit which operates the lamp in order to set, for example, the current which is intended to flow through the lamp.

In another embodiment, the output signal is implemented by means of a pulse-width-modulated signal. Using a pulse-width-modulated signal makes it possible to transmit the signals with relatively high resolution.

In another embodiment, the voltage supply for the semiconductor device is provided by the two supply connections during a first mode and is provided energy obtained from the signals at the antenna connections in a second mode. The semiconductor device can therefore be programmed even when the luminaire is not supplied with external voltage, which is generally preferred by installers when mounting lamps.

In another embodiment, a counter reading of the counter is stored in the storage unit, and the counter reads the counter reading from the storage unit before respectively starting the counting. It is therefore ensured that the operating hours remain stored even when there is no external voltage supply.

If the counter reading can be programmed by means of signals received from the antenna, it is easily possible to replace the luminous device without replacing the semiconductor device.

As a result of the fact that, in one embodiment, storage space for characteristic values describing the dependence of the output signal on the operating time (such as hours) is provided in the storage unit, and as a result of the fact that the characteristic values can be changed by the receiving unit, luminous hardware can also be easily replaced with luminous hardware of another type.

Note that embodiments herein further include a luminaire device having an instantiation of the semiconductor device as described herein, wherein the semiconductor device is connected to a control input connection of a luminaire driver.

It should be mentioned that the expression "connection" means not only a direct connection but also an indirect connection, in the case of which further elements are provided between the units to be connected. However, there must be a signal or energy flow between the two elements.

Accordingly, embodiments herein include a semiconductor device operative to output a control parameter, the semi device comprising: a receiving unit, a storage unit, and an output unit and at least five connections, of which: multiple antenna connections including a first antenna connection and a second antenna connection, each of the first antenna connection and the second antenna connection configured for connection to an antenna, multiple supply connections including a first supply connection and a second supply connection operative to supply the semiconductor device with electrical energy, an output connection operative to drive a signal for outputting the control parameter, wherein the receiving unit is connected to the multiple antenna connections, from which the receiving unit: receives signals, converts the signals into data and stores the data in the storage unit, and wherein the output unit outputs an output signal at the output connection based on data stored in the storage unit, a calculation unit of the semi device operative to determine operating hours of the semiconductor device, wherein the output signal depends on the determined operating hours.

In accordance with further embodiments, the semiconductor device includes: a counter operative to track the operating hours.

In still further embodiments, the output signal is an analog voltage.

In accordance with further embodiments, the output signal is a pulse-width-modulated signal.

The semiconductor device as described herein supports multiple modes based on input from different sources. For example, in one embodiment, the voltage supply for the semiconductor device is implemented (operated) via the multiple supply connections in a first mode and is implemented (operated) based on energy obtained from the signals at the antenna connections in a second mode.

Yet further embodiments of the semiconductor device as described herein include a counter. A counter reading generated by a counter is stored in the storage unit; the counter is operative to read the counter reading from the storage unit before operating the counter to start counting passage of time. In one embodiment, the counter reading is programmed via signals received at the multiple antenna connections.

In accordance with still further embodiments, the storage unit incudes storage space for characteristic values describing a dependence of the output signal on operating hours of the semiconductor device. The characteristic values can be changed by the receiving unit.

In accordance with further embodiments, the semiconductor device includes an antenna driver. In one embodiment, the antenna driver reads data from the storage unit and drives the multiple antenna connections to transmit the data.

Yet further embodiments herein a luminaire in which the semiconductor device resides. The semiconductor device is connected to a control input connection of a luminaire driver.

Further embodiments herein include a method of: via a semiconductor device: receiving signals; converting the signals into data; storing the data in a storage unit; and outputting an output signal, the output signal based on an operating time of the semiconductor device.

Further embodiments herein include tracking passage of the operating time via a counter.

Yet further embodiments herein include producing the output signal as an analog voltage.

Still further embodiments herein include producing the output signal as a pulse-width-modulated signal.

In one embodiment, the method includes: switching between operating the semiconductor device in: i) a first mode in which the semiconductor device operates off an input voltage from a first input of the semiconductor, and ii) a second mode in which the semiconductor device operates off energy received from an antenna.

Further embodiments herein include programming a counter of the semiconductor device via signals received over multiple antenna connections of the semiconductor device.

Yet further embodiments herein include reading data from a storage unit of the semiconductor device; and transmitting the data from multiple antenna connections of the semiconductor device.

BRIEF DESCRIPTION OF THE DRAWINGS

Exemplary embodiments of the herein are explained below using the drawings, in which.

DETAILED DESCRIPTION

Figure 1:
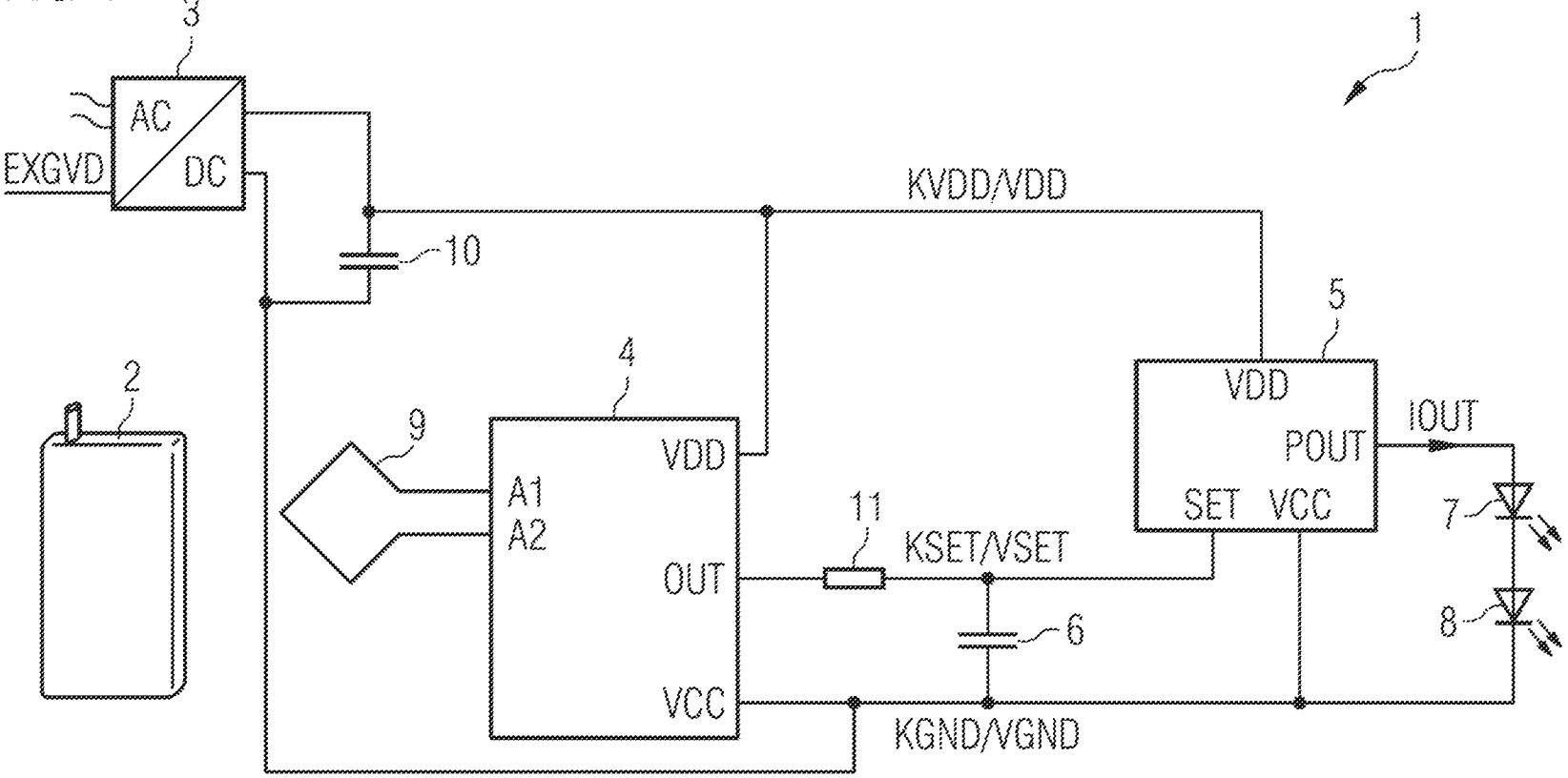
FIG. 1 shows a luminaire having a semiconductor device, with the aid of which a control parameter for the luminaire can be output.

FIG. 1 shows a luminaire 1 and a cellphone 2, with the aid of which a control parameter for the luminaire 1 can be set. The luminaire 1 contains an AC/DC converter 3, a semiconductor device 4, an antenna 9, an LED driver 5, a capacitor 6, a capacitor 10, a first light-emitting diode 7 and a second light-emitting diode 8.

The luminaire 1 receives, at its AC/DC converter 3, an AC voltage which is converted by this AC/DC converter 3 into a DC voltage between the node KVDD and the node KGND. This DC voltage is 3 V, for example. A capacitor 10 which can store electrical energy is provided between these two nodes. The semiconductor device 4 from FIG. 1 has five connections (such as pins, ports, circuit path, etc.). A first connection A1 and a second connection A2 are connected to the two ends of the antenna 9. The semiconductor device 4 is also connected, at two supply connections, to the voltage supply node KVDD and to the voltage supply node KGND. The fifth connection OUT is an output connection which outputs a signal for a control parameter. The control parameter is a measure of the light intensity here.

The output connection OUT is connected, via a resistor 11, to the node KSET which is also connected to a first connection of the capacitor 6, the second connection of which is connected to the supply node KGND. The voltage VSET-VGND is therefore applied to the capacitor. The LED driver 5 likewise contains two supply connections which are connected to the node KVDD and to the node KGND, respectively. At one input ISET, the LED driver is connected to the node KSET. An output connection POUT is connected to the anode of the first light-emitting diode 7, the cathode of which is connected to the anode of the second light-emitting diode 8. The cathode of the latter is in turn connected to the node KGND. It goes without saying that the number and arrangement of LEDs is purely exemplary.

The LED driver 5 generates, at its output connection POUT, a current, the absolute value of which depends on the input signal received at the input ISET. The light-emitting diodes 7 and 8 emit light if the current flowing through them exceeds a predefined absolute value. The brightness of the light-emitting diodes and therefore their luminous intensity depend on the level of the current and on the age of the light-emitting diodes. More or less luminous intensity is required depending on the placement in the room. If further light sources are in the vicinity of the luminaire, for example, an installer can set a lower luminous intensity of the luminaire than in the case of luminaires which are provided far away from further light sources. The installer accordingly programs the luminaires 1 using his cellphone 2.

In one embodiment, the semiconductor device 4 outputs a pulse-width-modulated signal at its output connection OUT. This pulse-width-modulated signal is subjected to low-pass filtering with the aid of the resistor 11 and the capacitor 6 in such a manner that an analog potential VSET results at the node KSET and is constant in the case of a constant pulse width ratio of the output signal at the output connection OUT, based again on the ground potential VGND. The absolute value of this analog potential VSET is proportional to the duty cycle of the pulse-width-modulated signal.

The LED driver 5 receives the analog signal VSET generated in this manner at its input ISET and sets the output current IOUT according to the absolute value of this analog signal.

The luminaire 1 can be set with the aid of the cellphone 2. A user guides the cellphone 2 in the vicinity of the antenna 9 in such a manner that, for example, an NFC (Near-Field Communication) connection is established between the cellphone 2 and the semiconductor device 4 via the antenna 9. In this case, radio-frequency signals can be transmitted via the antenna 9. These radio-frequency signals contain modulated signals which can be decrypted by the semiconductor device 4. The modulated signals code, for example, data which indicate the value of the desired luminous intensity.

However, the semiconductor device can also harvest energy from the radio-frequency signals, with the result that the voltage is supplied, at least in one operating mode of the semiconductor device 4, via the transmission of the radio-frequency signals.

Figure 2:
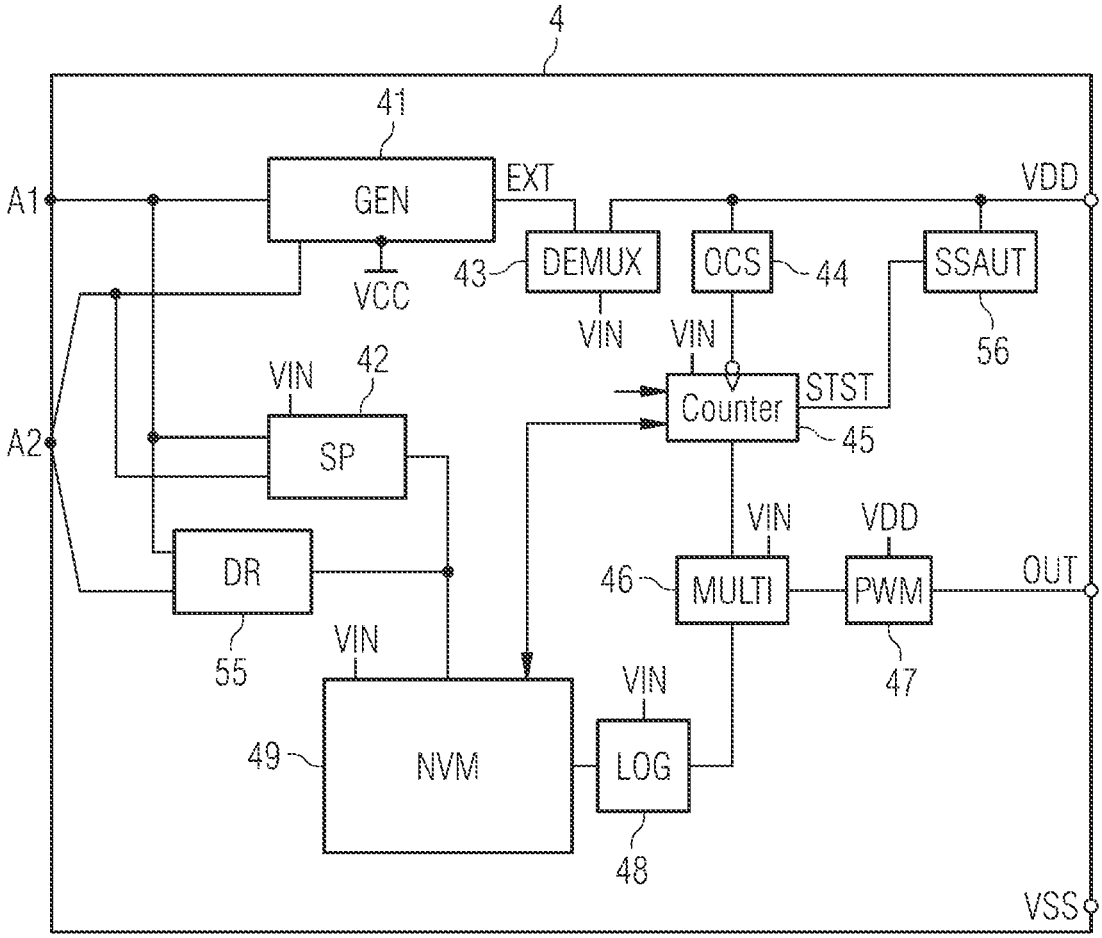
FIG. 2 shows a basic circuit diagram of the semiconductor device from FIG. 1.

FIG. 2 shows a basic circuit diagram of the semiconductor device from FIG. 1. The semiconductor device 4 contains a voltage generator 41, a receiving unit 42, a demultiplexer 43, an oscillator 44, a counter 45, an arithmetic unit 46, a pulse width signal generator 47, a control logic unit 48, a storage unit 49, an antenna driver 55 and an automatic start-stop system 50. As described above, the semiconductor device 4 is connected to the ends of the antenna 9 at the antenna connections A1 and A2. These connections are connected, on the one hand, to the voltage generator 41 and, on the other hand, to the receiving unit 42.

The voltage generator 41 is used to harvest energy from the radio-frequency signal at the connections A1 and A2. This energy is converted in such a manner that a potential of 3 V, for example, with respect to the ground potential VSS is output at the output of the voltage generator 41. The cellphone modulated data for transmission to the semiconductor device 4 onto the radio-frequency signal which is delivered to the connections A1 and A2 by means of the antenna. These modulated data are demodulated by the receiving unit 42 and are stored in the storage unit 49. This storage unit 49 is in the form of a non-volatile memory which retains its data even when the semiconductor device is no longer supplied with voltage.

The demultiplexer 43 receives, as input signals, on the one hand, the voltage EXT provided by the voltage generator 41 and, on the other hand, the voltage VDD provided by the voltage supply connections. Both voltages are referenced to the ground potential VSS at the supply connection VSS. The demultiplexer 43 outputs a voltage Vin at its output. As long as voltage is applied to the connection VDD, the voltage Vin is generated from VDD. If this voltage is not applied, the voltage Vin is generated from the voltage EXT if present. That is to say, most of the components of the semiconductor device 4 are operated both in the mode in which a voltage supply is applied to the supply connections and in the mode in which energy is generated only from the radio-frequency signal. However, the oscillator 44, the arithmetic unit 46, the pulse width signal generator 47 and the automatic start-stop system 50 are supplied only by the externally provided voltage VDD.

The oscillator 44 generates a clock signal at a frequency of several megahertz. This signal is output to the clock input of the counter 45. The counter 45 additionally receives, as an input signal, the signal STST which signals the start and stop of counting. This signal STST is generated by the automatic start-stop system 50. The latter generates a start signal if the voltage VDD, after it has been at a very low level, exceeds a particular threshold, for example 2.6 V. In this case, it is assumed that the external luminaire is also supplied with voltage, with the result that its operating time advances. The counter 45 counts the clock events which were generated by the oscillator 44. For this purpose, the counter 45 contains a plurality of dividers, with the result that it initially counts the seconds. These are divided by 3600, with the result that the counter can eventually output the hours. The counted hours are stored in a part of the storage unit 49. Storage is effected, on the one hand, when the counter has continued to count for four hours. In addition, the counter stores the current counter reading outside this four-hour rhythm when the signal STST signals a stop signal. This stop signal is generated by the automatic start-stop system 50 if the voltage VDD undershoots a particular threshold value. If this threshold value has been undershot, it can be assumed that the voltage will still fall further, with the result that the luminaire will no longer be supplied with voltage.

The external capacitor 10, see FIG. 1, ensures that the voltage VDD does not collapse too quickly, with the result that there is sufficient time to store the current counter reading in the storage unit 49. If the counter 45 starts to count again the next time on account of a new start signal, the counter 45 loads the counter reading, which was last stored in the storage unit 49, into the counter 45 again and begins to count on from this counter reading.

The receiving unit 42 receives, via the radio-frequency signal, data which it stores in the storage unit 49. These data contain, for example, information relating to the light intensity with which the LEDs 7 and 8 are intended to emit light. If a voltage supply is applied to the supply connections VDD and VSS, a corresponding value will be output at the connection OUT as a control parameter for the light-emitting diodes. For example, the fact that the LEDs 7 and 8 are intended to emit light with a luminous intensity which is 70% of the maximum luminous intensity has been stored in the storage unit 49. This value is read from the storage unit 49 by the logic unit 48 and is output to the arithmetic unit 46. The arithmetic unit 46 multiplies this value by a factor which is dependent on the targeted operating hours.

The counter 45 and the arithmetic unit 46 form a calculation unit which determines the operating hours and, for this purpose, makes the output signal dependent both on the operating hours and on the data stored in the storage unit for the parameter for the controlled device.

If the LEDs 7 and 8 are still relatively young, this factor is 78%, for example. This value is multiplied by the output value from the logic unit 48. Its result is output to the pulse width signal generator 47 which outputs a pulse-width-modulated signal, the duty cycle of which is a measure of the result value from the arithmetic unit 46.

In an alternative embodiment (not shown here), a DA converter is provided instead of a pulse width signal generator 47 and outputs an analog DC voltage which is a measure of the output signal from the arithmetic unit 46.

In one embodiment, the counter reading in the storage unit 49 can also be changed via the radio-frequency signal and the receiving unit 42. For example, the LEDs 7 and 8 are replaced with new luminous means, for example new LEDs. Accordingly, the installer can use his cellphone 2 to store a counter reading in the storage unit 49, which counter reading indicates that the operating hours are now 0 again. Accordingly, the counter 45 will then in future count the operating hours accrued for the new LEDs 7 and 8.

In the embodiment shown, the semiconductor device 4 also contains an antenna driver 55 which is connected to the antenna connections and can drive the antenna. This antenna driver makes it possible to transmit data from the semiconductor device to the cellphone 2 via the antenna. In one embodiment, the counter reading stored in the storage unit 49 is read by the antenna driver 55 and is transmitted to the cellphone 2 via the antenna connections A1 and A2 and the antenna 9. The installer or another user can therefore read the counter reading and therefore knows the operating hours which have elapsed. In addition, it is possible in embodiments to read further parts of the memory contents in order to check, for example, whether parts of the storage unit are defective. The antenna driver will typically produce a radio-frequency signal, will modulate the data to be transmitted onto the radio-frequency signal and will therefore drive the antenna connections.

Figure 3:
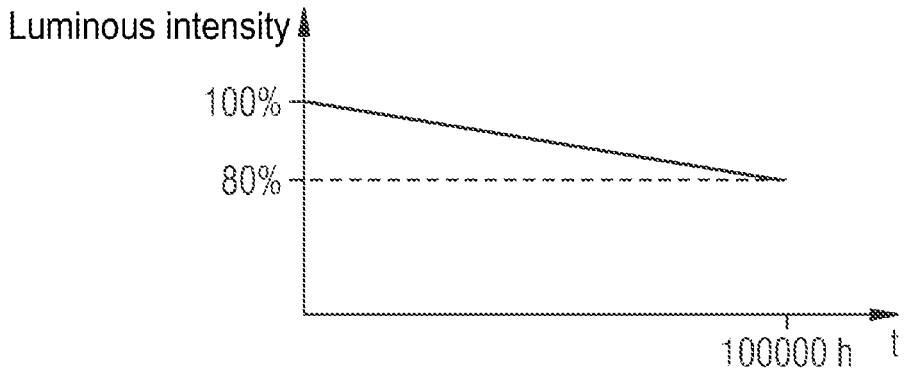
FIG. 3 shows the profile of the light intensity emitted by an LED in the case of constant current over time.

FIG. 3 shows the profile of the luminous intensity of a typical LED over the operating hours. This luminous intensity decreases, for example, from 100% to 80% at 100,000 operating hours.

Figure 4:
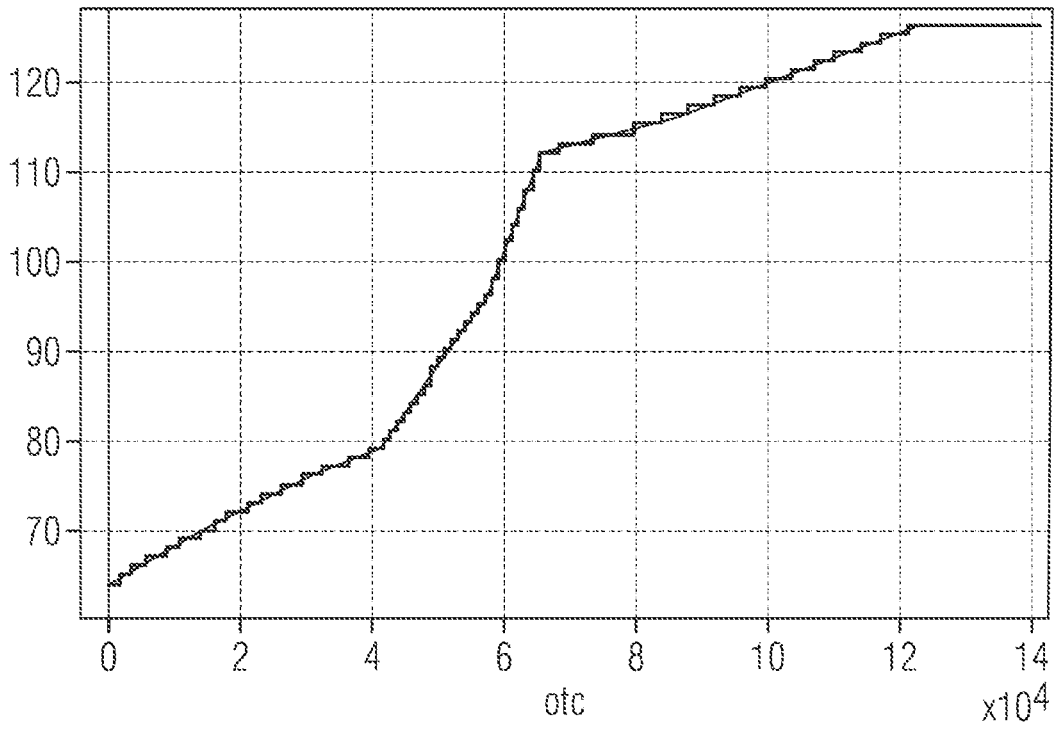
FIG. 4 shows the control parameter emitted by the semiconductor device from FIG. 2 over time.

FIG. 4 shows the profile of the factor output by the counter 48 over the operating hours. This factor is approximately 75% at the beginning and is approximately 128% at 120,000 operating hours. The illustrated function is a constantly rising stair function with 4 supporting points. The height of the stairs respectively changes at these supporting points. The supporting points of this function can also be stored in the storage unit 49 in one embodiment. In further embodiments, it is possible to change this function by means of reprogramming by means of the cellphone 2. This is useful, for example, if use is made of another luminous means whose ageing process differs from that in the previously used luminous means.

The description of the drawings explains the embodiments herein on the basis of examples and is not intended to be used to unreasonably reduce the scope of protection.

We claim:

1. A semiconductor device operative to generate a control signal, the semiconductor device comprising: a receiving unit, a storage unit, and an output unit, the semiconductor device further comprising:

multiple antenna connections including a first antenna connection and a second antenna connection, each of the first antenna connection and the second antenna connection operative to connect the semiconductor device to an antenna, multiple supply connections including a first supply connection and a second supply connection operative to supply the semiconductor device with electrical energy, an output connection operative to output the control signal, the control signal outputted from the output connection controlling a magnitude of light emitted from a light source, the receiving unit being connected to the multiple antenna connections, from which the receiving unit: receives input signals, converts the input signals into data and stores the data in the storage unit, and wherein the output unit outputs the control signal from the output connection based on the data stored in the storage unit, a calculation unit of the semiconductor device operative to determine a duration of time in which the semiconductor device previously generated the control signal to control supply of power to illuminate the light source, the calculation unit deriving a setting of the control signal that controls operation of the light source based at least in part on the determined duration of time.

2. The semiconductor device as in claim 1 further comprising: a counter operative to track the duration of time.

3. The semiconductor device as in claim 2, wherein a counter value generated by the counter is stored in the storage unit, and wherein the counter is operative to read the counter value from the storage unit before resuming operation of the counter to monitor passage of time in which the light source is activated via the control signal.

4. The semiconductor device as in claim 3, wherein the counter value is programmed via signals received at the multiple antenna connections.

5. The semiconductor device as claimed in claim 1, wherein the control signal is an analog voltage.

6. The semiconductor device as in claim 1, wherein the control signal is a pulse-width-modulated signal.

7. The semiconductor device as in claim 1, wherein the semiconductor device is powered via a first voltage received over the multiple supply connections in a first mode and is powered by energy obtained from the signals received over the antenna connections in a second mode.

8. The semiconductor device as in claim 1, wherein storage space for characteristic values describing a dependence of the output signal on operating times of the semiconductor device is stored in the storage unit, and wherein the characteristic values can be changed by the receiving unit.

9. The semiconductor device as in claim 1 further comprising: an antenna driver operative to read data from the storage unit and drive the multiple antenna connections to wirelessly transmit said data.

10. The semiconductor device as in claim 1, wherein the calculation unit is operative to receive a factor value, a magnitude of which varies depending on the duration of time.

11. The semiconductor device as in claim 10, wherein the calculation unit is operative to generate the control signal via multiplying the factor value by a control value.

12. The semiconductor device as in claim 11, wherein the magnitude of the factor value increases as the magnitude of the duration of time increases.

13. The semiconductor device as in claim 11, wherein the control value is received over the antenna, the control value indicating an intensity of the light emitted from the light source.

14. The semiconductor device as in claim 1 further comprising:

a counter operative to track the duration of time via retrieval of the data from the storage unit.

15. The semiconductor device as in claim 1, wherein the data indicates a setting of an intensity of the light emitted from the light source; and wherein the setting as specified by the data is multiplied by a factor to produce the control signal.

16. The semiconductor device as in claim 15, wherein the magnitude of the factor depends on the duration of time.

17. A luminaire including the semiconductor device and the light source as in claim 1, wherein the control signal from the semiconductor device is supplied to a luminaire driver that drives the light source based on the control signal.

18. An apparatus comprising the semiconductor device as in claim 1, the apparatus further comprising:

a driver operative to receive the control signal and supply current to the light source depending on the setting of the control signal; and a voltage monitor resource operative to monitor a power supply voltage powering the driver, the voltage monitor resource disabling a respective counter that tracks the duration of time that the control signal activates the light source in response to detecting that the power supply voltage falls below a threshold value.

19. The apparatus as in claim 18, wherein the semiconductor device is further operative to wirelessly communicate a value indicative of the duration of time over the antenna to a communication device.

20. An apparatus comprising the semiconductor device of claim 1, the apparatus further comprising:

a filter operative to receive the control signal and produce voltage value that controls a current driver, the current driver controlling a magnitude of the light emitted from the light source.

21. A method comprising:

via a semiconductor device:

receiving input signals;

converting the input signals into data;

storing the data in a storage unit;

updating the data in the storage unit over time to track a duration of time of activating a light source;

deriving a control signal from the updated data in the storage unit, the control signal controlling operation of the light source, a setting of the control signal derived based at least in part on the duration of time; and outputting the control signal to control the light source.

22. The method further as in claim 21, wherein the updated data tracks the duration of time that the control signal controls the light source to an illuminated state over time.

23. The method as in claim 21 further comprising: producing the control signal as an analog voltage.

24. The method as in claim 21 further comprising: producing the control signal as a pulse-width-modulated signal.

25. The method as in claim 21 further comprising: switching between operating the semiconductor device in: i) a first mode in which the semiconductor device is powered via an input voltage from a first input of the semiconductor, and ii) a second mode in which the semiconductor device is powered via wireless energy received from an antenna.

26. The method as in claim 21 further comprising: programming a counter of the semiconductor device via the data received over multiple antenna connections of the semiconductor device.

27. The method as in claim 21 further comprising:

retrieving the updated data from the storage unit of the semiconductor device; and wirelessly transmitting the updated data to a remote communication device.

* * * * *